US007156667B2

(12) United States Patent
Ge et al.

(10) Patent No.: US 7,156,667 B2
(45) Date of Patent: Jan. 2, 2007

(54) ELECTRONIC CARD ASSEMBLY

(75) Inventors: Ming Ge, Kunshan (CN); GuoHua Zhang, Kunshan (CN); ZiQiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/212,540

(22) Filed: Aug. 26, 2005

(65) Prior Publication Data

US 2006/0116003 A1 Jun. 1, 2006

(30) Foreign Application Priority Data

Dec. 1, 2004 (CN) ..... 2004 2 0109410

(51) Int. Cl.
*H01R 12/00* (2006.01)

(52) U.S. Cl. ..... 439/64

(58) Field of Classification Search ..... 439/64, 439/630–631, 945, 76.1; 361/684, 737, 212, 361/220, 818

See application file for complete search history.

(56) References Cited

U.S. PATENT DOCUMENTS 5,038,250 A * 8/1991 Uenaka et al. ..... 361/737
5,481,434 A 1/1996 Banakis et al.
6,224,391 B1 * 5/2001 Horie et al. ..... 439/64
6,320,252 B1 11/2001 Potters et al.
6,853,550 B1 2/2003 Tseng et al.
6,932,623 B1 * 8/2005 Lai ..... 439/76.1
6,976,624 B1 * 12/2005 Hsiao ..... 235/451
2002/0119681 A1 * 8/2002 Follingstad et al. ..... 439/64

* cited by examiner

*Primary Examiner*—Jean F. Duverne
(74) *Attorney, Agent, or Firm*—Wei Te Chung

(57) ABSTRACT

An electronic card assembly comprising a circuit board (1) interposed between two shells (4,5), an insulative frame (3) supporting said circuit board and comprising a pair of protrusions (35) oppositely formed at a front end thereof, a connector (2) assembled to the insulative frame and comprising conductive contacts electrically connecting with the circuit board. A receiving section (34) is integrally disposed at the rear end of the insulative frame. The connector has a longitudinal base (20) and a pair of L-shaped arms (21) extend from opposite sides of the base. A pair of connecting blocks (25) are oppositely disposed at each arm and a slot (23) is provided between each block and the base. The slots receive respective protrusion therein to thereby secure the connector to the insulative frame.

17 Claims, 5 Drawing Sheets

ELECTRONIC CARD ASSEMBLY

BACKGROUND OF THE INVENTION

1. Field of the Invention

The present invention relates to an electronic card assembly, and particularly to an electronic card assembly having a securing means for firmly assembling the assembly.

2. Description of Related Art

In general, an electronic card includes a frame which is generally rectangular and may include an opening receiving a circuit substrate in either a top surface or a bottom surface thereof or, in most construction, in both surfaces. A connector is located at one side of the frame and electrically connects with the circuit substrate. A panel or cover is provided for enclosing the circuit substrate and the connector within the frame. The dimensions of the electronic card is limited due to requirements to conform to particular specifications or standards, such as those defined by Personal Computer Memory Card International Association (PCMCIA).

With the dimensions of some electronic apparatus becoming smaller and smaller while the data transmission velocity becoming faster and faster, manufacturers have realized the traditional electronic card cannot be satisfied in the needs of high velocity and small dimension. In spring of 2003, the PCMCIA introduced a new standard named ExpressCard. The ExpressCard standard promises to deliver a thinner, faster and lighter modular expansion to desktop and notebook computer users. Consumers will be able to add hardware capabilities such as memory, wired and wireless communication cards and security devices by simply inserting these modules into their systems.

The traditional card usually employ protrusions projecting sideward from the rear ends of two opposite sides of the connector and fixedly retained in receiving spaces of the frame to joint the connector and the frame together. However, the ExpressCard have a smaller dimension (34 mm×75 mm or 54 mm×75 mm) and the above-mentioned protrusion is unsuitable for it takes up a big space.

Accordingly, an improved electronic card assembly to overcome the disadvantages of the related arts is highly desired.

SUMMARY OF THE INVENTION

One object of the present invention is to propose an electronic card assembly having a structure to hold an electrical connector reliably. The electronic card assembly has a frame for receiving and supporting the connector.

In order to achieve the above-mentioned object, an electronic card assembly comprises a pair of card shells; a circuit board; an insulative frame and a connector. The circuit board is interposed between the pair of card shells. The insulative frame supports the circuit board and comprises a pair of protrusions oppositely formed at a front end of it. The connector is assembled to the insulative frame and comprises a plurality of conductive contacts electrically connecting with the circuit board. The connector has a base having a pair of arms extending from opposite sides of the base and there oppositely disposed a connecting block at the end of the each arm, a slot is provided between the block and the base and firmly receives said protrusion correspondingly.

Other objects, advantages and novel features of the invention will become more apparent from the following detailed description when taken in conjunction with the accompanying drawings.

DETAILED DESCRIPTION OF THE PREFERRED EMBODIMENT

Figure 1:
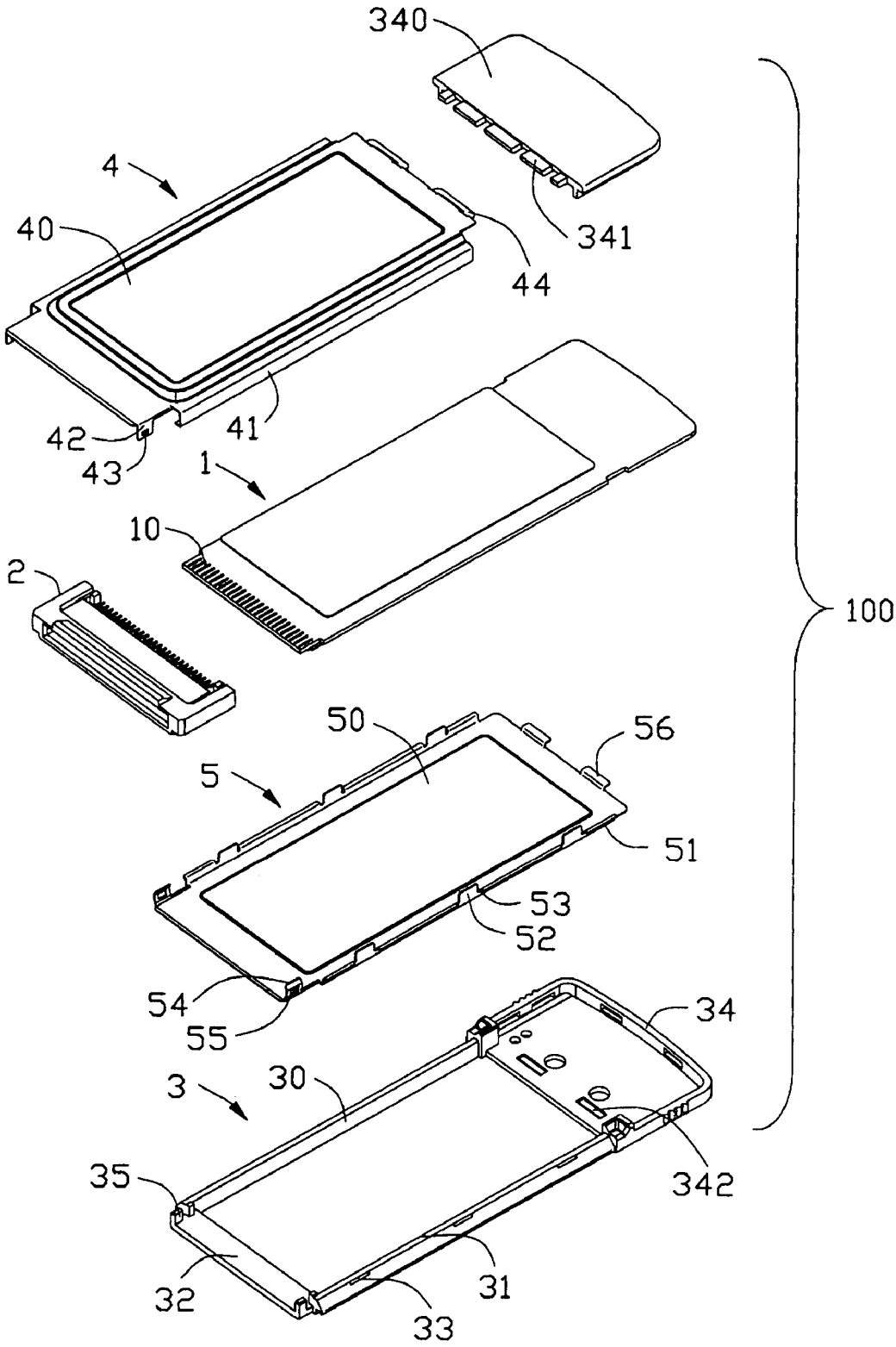
FIG. 1 is an exploded perspective view of an electronic card assembly according to the present invention.

Referring to FIG. 1, an electronic card assembly 100 comprises a circuit board 1, a connector 2, an insulative frame 3, an upper and a lower shells 4 and 5.

Figure 2:
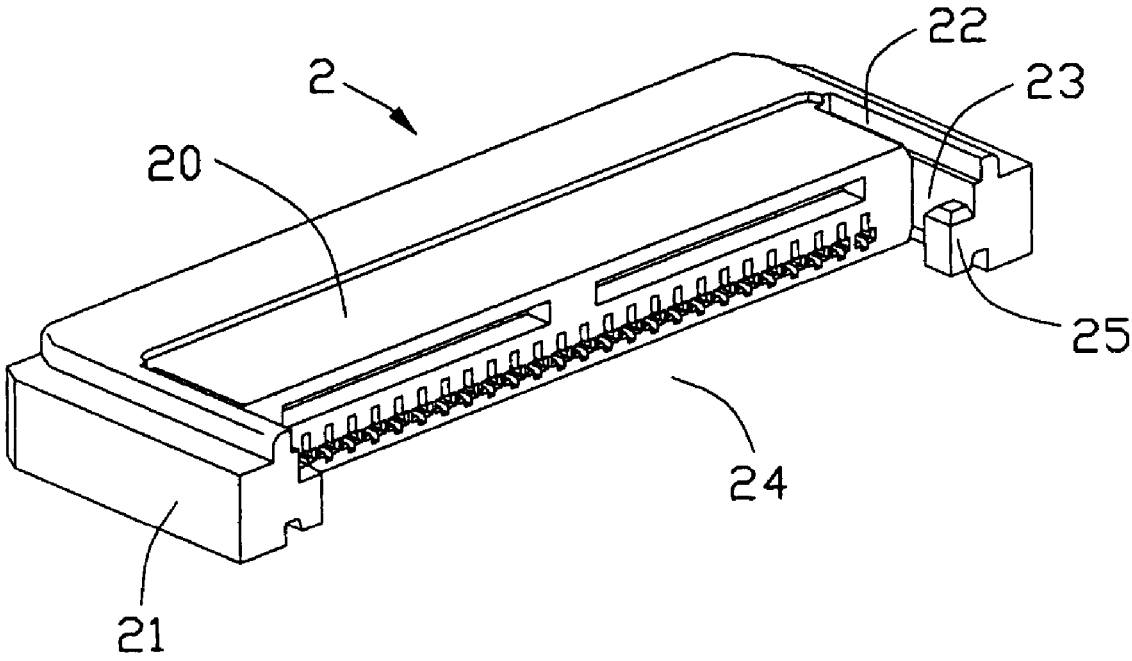
FIG. 2 is a perspective view of a connector of the present invention.

Referring to FIG. 1 and FIG. 2, the circuit board 1 lies between the upper and lower shells 4 and 5. At one end of the circuit board 1, there are a plurality of conductive pads 10. The connector 2 has a base 20. Two L-shaped arms 21 respectively extend rearward from opposite sides of the base 20 and form a receiving space 24 therebetween. A groove 22 is defined between the base 20 and a respective L-shaped arm 21. The slots 23 of the L-shaped arms 21 are appreciably disposed in a parallel relationship. Two connecting blocks 25 are formed at the rear ends of the L-shaped arms 21.

Figure 3:
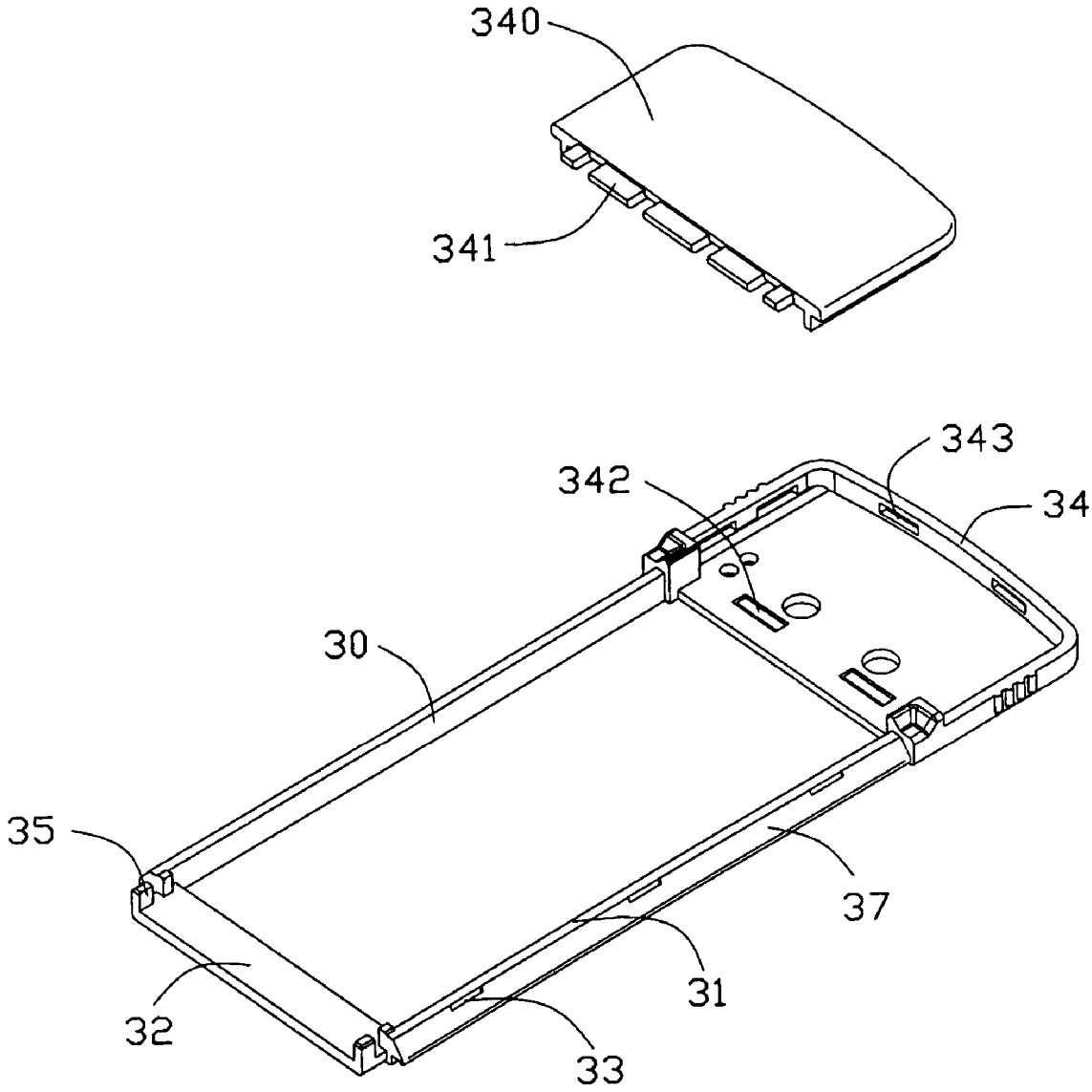
FIG. 3 is a perspective view of an isulative frame and a detachable cover of the present invention.
Figure 4:
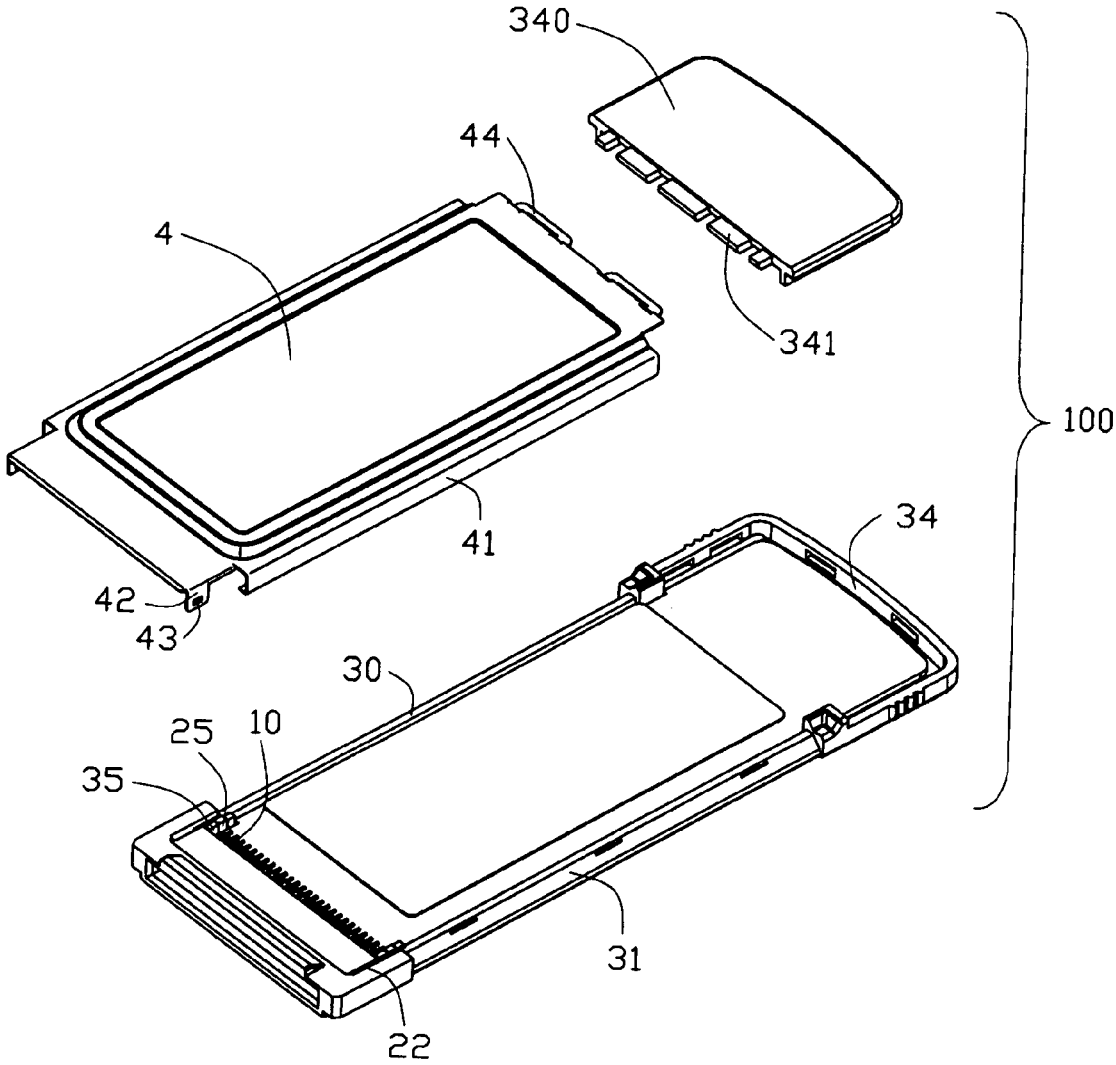
FIG. 4 is a partially assembled perspective view of the electronic card assembly and shown in FIG. 1.
Figure 5:
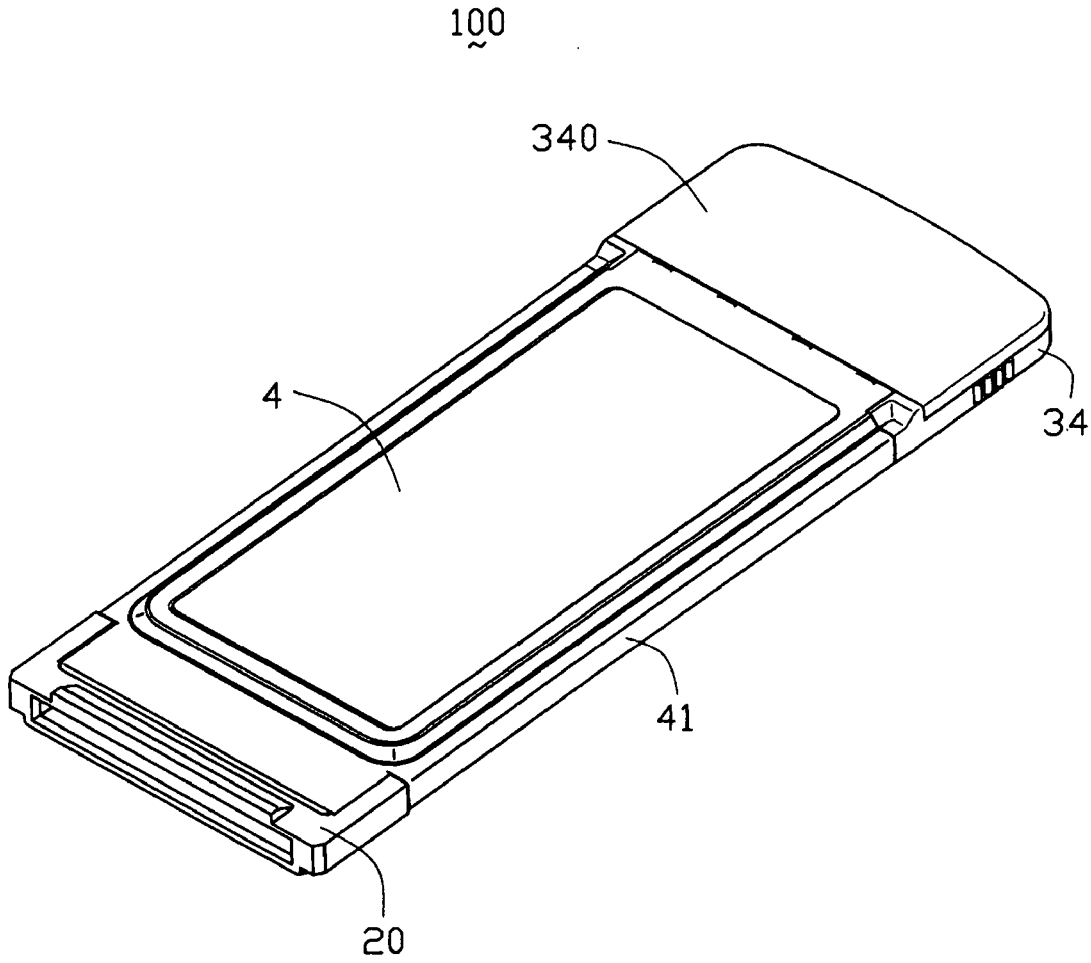
FIG. 5 is an assembled view of FIG. 1.

Referring to FIG. 3, the insulative frame 3 is integrally formed as a rectangular member and includes a first bar 30, a second bar 31 and a transverse bar 32 connecting the first bar 30 and the second bar 31. At each of the transverse ends of the transverse bar 32, there is a protrusion 35 providing upwardly. A receiving section 34 extends rearward from a rear side edge of the insulative frame 3 and includes a detachable cover 340 thereof. The receiving section 34 is integrally formed with the insulative frame 3. Each bar 30, 31 of the insulative frame 3 has a slant surface 37. A plurality of grooves 33 are respectively defined on the slant surfaces 37.

Referring to FIG. 1, the upper and lower shells 4 and 5 are made of metal and rectangular-shaped. Two sidewalls 41 extend downwardly from opposite sides of the upper shell 4. A pair of first front retention members 42 is respectively disposed at two opposite sides of a front end of the upper shell 4. Each first front retention member 42 has a projection 43.

Bend portions 51 are formed at two opposite edges of the lower shell 5. A plurality of position tabs 52 are disposed on the bend portions 51. Interference portions 53 extend from opposite side edges of each position tabs 52 for facilitating the retention of the position tabs 52 and the grooves 33 of the first bar 30 and second bar 31. A pair of second front retention members 54 is respectively disposed at two sides of a front end of the lower shell 5. Each second front retention member 54 has a hole 55 receiving the projection 43.

Two first connecting members 44 are formed at a rear end of the upper shell 4, and two second connecting members 56 are formed at a rear end of the lower shell 5. A plurality of plugging protrusions 341 are disposed at a forward end of the detachable cover 340. Two gaps 342 are formed at a front edge of the receiving section 34.

Referring to FIG. 1 to FIG. 5, in assembly, a plurality of terminals received in the connector 2 are soldered to conductive pads 10 of the circuit board 1. The receiving space 24 of the connector 2 accommodates therein the front edge of the circuit board 1. The circuit board 1 is placed in the insulative frame 3 and simultaneously, the two protrusions 35 are correspondingly inserted into the slots 24 of the L-shaped arms 21. Then, each protrusion 35 clamps the corresponding connecting block 25 firmly and help to assemble the connector 2 securely. The receiving section 34 actually forms a room. And according to the requirements, some electron components (not shown) can be received in the receiving section 34.

The lower shell 5 is assembled onto the nether bottom of the insulative frame 3, The two second connecting members 56 are inserted into the gaps 342. The upper shell 4 is assembled onto the upper surface of the insulative frame 3 and the sidewalls 41 pressed and embracing the bend portions 51 of the lower shell 5. The plugging protrusions 341 of the detachable cover 340 are inserted into the two first connecting members 44 and the locking posts (not shown) of the detachable cover 340 lock with the fixing holes 343 of the receiving section 34. The upper shell 4 and the lower shell 5 extend forwardly and envelope the outward surfaces of the base 20. The detachable cover 340 is connected with the upper and lower shells 4,5. Then, the present invention provides a better holding structure to tightly fix the connector 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electronic card assembly, comprising:

a pair of card shells;

a circuit board interposed between the card shells;

an insulative frame supporting said circuit board, the insulative frame including a pair of longitudinal bars and a traverse bar connecting front ends of said pair of longitudinal bars, the traverse bar comprising a pair of protrusions extending upwardly from opposite sides thereof; and a connector assembled to the insulative frame and comprising a plurality of conductive contacts electrically connecting with said circuit board;

wherein said connector has a base and a pair of arms extending rearwardly from opposite sides of the base, a pair of connecting blocks being respectively provided on a rear end portion of a corresponding arm and extending inwardly toward each other, a slot being provided between each connecting block and the base and firmly receiving a corresponding protrusion to thereby securing said connector to said insulative frame.

2. The electronic card assembly as claimed in claim 1, wherein the insulative frame is formed as a rectangular member.

3. The electronic card assembly as claimed in claim 1, wherein the pair of bars supporting said circuit board, and each bar has a slant surface and a plurality of grooves are respectively defined on the slant surface.

4. The electronic card assembly as claimed in claim 1, wherein a receiving section is disposed at a rear end of said insulative frame.

5. The electronic card assembly as claimed in claim 1, wherein a pair of grooves is respectively defined between the base and a corresponding arm, and each said groove is adjacent to said corresponding slot in a same direction.

6. The electronic card assembly as claimed in claim 1, wherein said arms are L-shaped.

7. The electronic card assembly as claimed in claim 3, wherein said pair of card shells encloses said pair of bars and said circuit board from upper and lower directions.

8. The electronic card assembly as claimed in claim 4, wherein said receiving section has a detachable cover.

9. The electronic card assembly as claimed in claim 7, wherein two first front retention members are disposed at two opposite sides of a front end of the upper shell, and two second front retention members is disposed at two sides of a front end of the lower shell.

10. An electronic card assembly, comprising:

a pair of card shells;

a circuit board interposed between the card shells;

an insulative frame supporting said circuit board and comprising a pair of protrusions oppositely formed at a front end thereof; and a connector assembled to the insulative frame and comprising a plurality of conductive contacts electrically connecting with said circuit board;

wherein said connector has a base, a pair of arms extending from opposite sides of the base and a pair of connecting blocks oppositely disposed at each arm, a slot is provided between each block and the base and firmly receives said protrusion correspondingly to thereby secure said connector to said insulative frame;

wherein the insulative frame includes a pair of bars supporting said circuit board, and each bar has a slant surface and a plurality of grooves are respectively defined on the slant surface; and wherein two sidewalls extend downwardly from opposite sides of the upper card shell of said pair of card shells, and two bend portions are formed at two opposite edges of the lower shell, correspondingly a plurality of fixing tabs are disposed on the bend portions and are inserted into said grooves to thereby fix said lower shell on said bars.

11. The electronic card assembly as claimed in claim 9, wherein a projection is provided on each first front retention member.

12. The electronic card assembly as claimed in claim 9, wherein a hole is provided in each second front retention member.

13. An electrical connector comprising:

an insulative frame having an extension portion at a first end;

an opening formed at a second end opposite to the first end;

a printed circuit board disposed in the frame including said extension portion;

top and bottom metallic covers vertically enclosing said frame except said extension portion an electrical connector located at said other end in said opening, and electrically connected to the printed circuit board; wherein an detachable cover is attached to the extension portion under a condition that one end of said detachable cover includes a plurality of protrusions latched to corresponding connecting members of the top metallic cover, and the other end of said detachable cover cooperates with the first end to seal the extension portion.

14. The connector as claimed in claim 13, wherein said detachable cover covers said extension portion in a vertical direction.

15. The connector as claimed in claim 13, wherein said detachable cover is insulative.

16. The connector as claimed in claim 13, wherein a pair of protrusions are formed on one of the connector and said other end of the frame, and a pair of slots are formed in the other of said connector and said other end of the frame to receive said pair of protrusions, respectively.

17. The connector as claimed in claim 13, wherein said detachable cover is essentially coplanar with the top metallic cover.

* * * * *